United States Patent [19]

Hayes

[11] 4,011,107

[45] Mar. 8, 1977

[54] BORON DIFFUSION COATING PROCESS

[75] Inventor: William J. Hayes, Shelby, Mich.

[73] Assignee: Howmet Corporation, Greenwich, Conn.

[22] Filed: Oct. 8, 1975

[21] Appl. No.: 620,634

Related U.S. Application Data

[63] Continuation of Ser. No. 479,775, June 17, 1974, abandoned, which is a continuation-in-part of Ser. No. 220,477, Jan. 24, 1972, abandoned.

[52] U.S. Cl. ..... 148/6; 427/383 D

[51] Int. Cl.[2] ..... C23F 7/00; C23C 9/02

[58] Field of Search ..... 148/6.35, 6; 427/383

[56] References Cited

UNITED STATES PATENTS

| | | | |
|---|---|---|---|
| 2,949,390 | 8/1960 | Feder et al. | 148/6 |
| 3,029,162 | 4/1962 | Samuel | 148/6.3 |
| 3,673,005 | 6/1972 | Kunst | 148/6 |
| 3,787,245 | 1/1974 | Kunst | 148/6.3 |

*Primary Examiner*—Ralph S. Kendall

[57] ABSTRACT

This invention is addressed to a process for the diffusion coating of metals which are capable of forming a compound or a solid solution with boron by contacting the metal with boron at a temperature greater than 1350° F.

6 Claims, No Drawings

BORON DIFFUSION COATING PROCESS

This is a continuation of application Ser. No. 479,775, filed June 17, 1974, now abandoned which is a continuation-in-part of copending application Ser. No. 220,447, filed Jan. 24, 1972 now abandoned.

The invention relates to a method for the diffusion coating of metals with boron.

It is known that the coating of various metals with boron can serve to increase the hardness of the metal. For example, it has been found that the boron diffusion coating of steel can be used as a method of hard facing the steel to hardnesses greater than those of sintered tungsten carbide.

Even though there has been substantial interest in processes for diffusion coating with boron, to the present, the prior art has been unable to provide a method for the diffusion coating of metals with boron which is capable of indiffusing boron to significant depths into the metal to provide other than a surface coating.

It is accordingly an object of the present invention to provide a method for the diffusion coating of metal surfaces with boron which overcomes the foregoing disadvantages, and it is a more specific object of the invention to provide a method for the diffusion coating of metal surfaces with boron in which the boron in the form of the boride of the metal being coated is indiffused to greater depths, which can be carried out in a simple and economical manner without the use of activators and which is capable of increasing not only the hardness of the surface metal but also the metal at depths significantly below the surface of the metal.

The concepts of the invention reside in a method for the diffusion coating of metals with boron to form borides of the metals being coated wherein a metal surface is contacted with elemental boron at a temperature of at least 1350° F. It has been found that the boron is indiffused into the metal surface to form the corresponding boride of the metal, which can be found at improved depths beneath the metal surface and serves to impart to the metal increased hardness.

In the practice of the present invention, the metal part to be coated is preferably packed in an elemental boron containing powder, and the resulting pack heated to the desired temperature. As the boron-containing powder, use can be made of commercially pure amorphous boron, although it is generally preferred that the pack powder be composed of a mixture of boron and an inert filler material, such inert refractory oxides or refractory salts including zirconium oxide, silica, alumina, calcium fluoride etc., as well as mixtures thereof. Generally, a boron content of 0.2 to 15%, and preferably 0.5 to 10%, by weight based on the total weight of boron and filler is sufficient. It is generally advisable to make use of greater amounts of boron within these ranges when the metal for coating is formed in complex shapes or contains holes or openings.

In accordance with one embodiment of the invention, the metal surface to be diffusion coated can be sprayed or precoated with a mixture of boron and an organic binder which serves to bond the boron-containing coating to the metal surface. Thereafter, the precoated metal surface can be packed in a pack of inert filler of the type described above (e.g., an aluminum oxide) which may or may not contain boron in admixture with the filler. This variation on the method of the invention provides an effective means to form a boron diffusion coating of limited thickness.

The organic binder serves only to bond the boron to the metal surface, and is essentially burned off when the pack is heated to effect the diffusion coating. For this reason, any film forming organic polymeric material which is capable of adhering to the metal surface can be used.

As indicated above, the metal surface in contact with the boron should be heated to a temperature of at least 1350° F. to effect the diffusion coating thereof. Increasing the temperature above this minimum serves to increase the diffusion coating rates due to the increase of the diffusion coating rates with temperature. For this reason, the maximum temperature depends upon the substrate to be coated, the time over which the diffusion coating is effected and the desired thickness of the coating. Obviously, the maximum temperature should not be a temperature which causes distortion of the substrate. In general, diffusion coatings can be carried out at temperatures within the range of 1350° to 2500° F. for times varying from 0.25 to 25 hours.

One of the surprising features of the present invention resides in the fact that the use of relatively dilute boron concentrations in the powder pack provides significantly increased depths of penetration of boron in the diffusion step without the use of halide activators. As is known to those skilled in the art, diffusion coating processes are frequently carried out using activators such as the chlorides and fluorides of ammonium or alkali metals to increase the rate of diffusion of the diffusable material into the substrate. It has been found in accordance with the practice of this invention that the use of such activators is unnecessary to provide significant depths of penetration, even with a boron pack containing 0.2 to 15% by weight boron based upon the total weight of the boron and inert filler material.

The process of the present invention is preferably carried out under an inert gas to minimize oxidation and the like from the atmosphere. For this purpose, use can be made of a blanket of an inert gas which does not react under the diffusion coating conditions with either boron or the metal substrate. Representative of such gases include argon, hydrogen, helium, etc.

The process of the invention can be carried out in any suitable apparatus. Steel retorts can be simply and economically used to contain the pack. Steel cannot be used, however, at temperatures when melting becomes a problem due to the formation of the boron-iron eutectic. Ceramic or graphite vessels can also be used and are quite suitable for temperatures in excess of 2050° F.

The concepts of the present invention are applicable to a wide variety of metal substrates, provided that the metal or alloy:

1. have a melting point at a temperature above 1350° F., the minimum diffusion coating temperature of the process;
2. be capable of forming a compound or a solid solution with boron; and
3. not react appreciably with small amounts of contaminants (e.g., oxygen, nitrogen, water) which may be present in the pack powder and/or the furnace atmosphere.

The process of the present invention is particularly well suited for the diffusion coating of steel, as well as the complete range of iron, nickel and cobalt alloys. In addition, the concepts of the invention are likewise applicable to the diffusion coating of molybdenum, tungsten and alloys thereof. Metals which cannot be diffusion coated in accordance with the present invention are aluminum because of its melting point, copper and silver because neither forms compounds or solid solutions with boron and titanium because it is too reactive with minor amounts of contaminants.

Having described the basic concepts of the invention, reference is made to the following examples, which are provided by way of illustration and not by way of limitation, of the practice of the invention.

EXAMPLE 1

A 4340 steel is packed in a powder containing 99% by weight aluminum oxide and 1% amorphous boron powder, and the resulting pack was heated to a temperature of 1700° F for a time of 0.5 hours under an atmosphere of argon.

The resulting diffusion coated steel is then subjected to analysis to determine its microstructure. It is found that the coating is 2.0 mils thick and contains primarily $Fe_2B$, with smaller amounts of the boron-rich compound FeB being found to a depth of 0.2 mil near the surface.

EXAMPLE 2

Using the procedure described in Example 1, a specimen of the same type of steel as employed in Example 1 is packed in amorphous boron without inert filler, and the resulting pack is heated to a temperature of 1700° F for 0.5 hour.

The product is found to have a diffusion coating having a total thickness of 3.1 mils, with the thickness of the FeB layer being 1.6 mils.

EXAMPLE 3

Using the procedure described in Example 1, a specimen of D-2 tool steel is packed in a mixture of 1% by weight boron and 99% by weight alumina.

The pack is then heated to 1850° F for 3 hours. The composition and hardness of the coating as measured from the surface of the steel is set forth in the following table:

Table I

| Distance from surface (mils) | Knoop microhardness | Composition of layer |
|---|---|---|
| 0.5 | 1580 | FeB layer |
| 1.0 | 3050 | FeB layer |
| 1.5 | 2670 | FeB layer |
| 2.0 | 3180 | FeB layer |
| 2.5 | 2320 | $Fe_2B$ layer |
| 3.0 | 2670 | $Fe_2B$ layer |
| 3.5 | 1265 | |
| 4.0 | 755 | |
| 4.5 | 944 | |
| 5.5 | 898 | |
| 6.5 | 898 | Core |

As can be seen from the foregoing, the hardness of the steel specimen was significantly increased, even at depths several mils from the surface. As can also be seen from the above table, the boron-rich FeB predominates near the surface while the $Fe_2B$ predominates below the surface.

EXAMPLE 4

A specimen of the steel employed in Examples 1 and 2 is first sprayed with slurry of amorphous boron in an organic binder. Thereafter, the boron-coated specimen is packed in a powder containing 99% by weight alumina and 1% by weight amorphous boron.

The pack is then heated to 1700° F. for 0.5 hour to produce a diffusion coating having a total thickness of 3.1 mils and a FeB layer thickness of 0.7 mil.

EXAMPLE 5

Using the procedure described in Example 1, a specimen of molybdenum is packed in a pack of 1% by weight boron and 99% by weight alumina, and the pack is heated to 1400° F. for 15 hours. The total thickness of the diffusion coating is 0.15 mil.

EXAMPLE 6

The procedure of Example 5 is repeated, using a specimen of tungsten in the pack which is heated to 1500° F. for 20 hours.

The total thickness of the diffusion coating is 1.0 mil.

EXAMPLE 7

The procedure of Example 1 is repeated, using a high carbon steel and a pack containing 2% by weight boron, 49% by weight $ZrO_2$ and 49% by weight $SiO_2$.

Comparable results are obtained.

It will be understood that various changes and modifications can be made in the details of procedure, formulation and use without departing from the spirit of the invention, especially as defined in the following claims.

I claim:

1. A process for the diffusion coating of metals with boron, comprising the steps of packing a solid metal substrate in which the metal is free from titanium and is capable of forming a compound or solid sollution with boron, said metal being selected from the group consisting of iron alloys, nickel alloys, cobalt alloys, molybdenum, tungsten and alloys thereof having a melting point at a temperature above 1350° F, with a composition consisting essentially of a refractory oxide or refractory salt and boron in an amount within the range of 0.2 to 15% by weight based upon the metal of the oxide or salt and the boron, and heating the pack to a temperature above 1350° F under non-oxidizing conditions to diffusion coat the substrate.

2. A process as defined in claim 1 wherein the refractory oxide or salt is selected from the group consisting of aluminum oxide, silica, zirconium oxide, calcium fluoride and mixtures thereof.

3. A process as defined in claim 1 wherein the metal contains a surface coating of boron in an organic binder.

4. A process as defined in claim 1 wherein the process is carried out at a temperature within the range of 1350° F. to 2500° F.

5. A process as defined in claim 1 wherein the process is carried out for 0.25 to 25 hours.

6. A process as defined in claim 1 wherein the process is carried out under a blanket of an inert gas.

* * * * *